US010022024B2

(12) United States Patent
Ciavarella et al.

(10) Patent No.: US 10,022,024 B2
(45) Date of Patent: Jul. 17, 2018

(54) ROTARY PERISTALTIC DOME PUMP

(71) Applicant: GOJO Industries, Inc., Akron, OH (US)

(72) Inventors: Nick E. Ciavarella, Seven Hills, OH (US); John J. McNulty, Broadview Heights, OH (US); Stephen A. Levy, Pittsburgh, PA (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/296,452

(22) Filed: Oct. 18, 2016

(65) Prior Publication Data

US 2017/0112332 A1 Apr. 27, 2017

Related U.S. Application Data

(60) Provisional application No. 62/245,629, filed on Oct. 23, 2015.

(51) Int. Cl.

| | |
|---|---|
| ***F04B 17/03*** | (2006.01) |
| ***F04B 23/02*** | (2006.01) |
| ***F04B 43/12*** | (2006.01) |
| ***A47K 5/14*** | (2006.01) |
| ***A47K 5/12*** | (2006.01) |
| ***F04B 13/00*** | (2006.01) |
| ***F04B 43/00*** | (2006.01) |
| ***F04B 43/04*** | (2006.01) |

(52) U.S. Cl.

CPC ..... *A47K 5/14* (2013.01); *A47K 5/1215* (2013.01); *A47K 5/1217* (2013.01); *F04B 13/00* (2013.01); *F04B 17/03* (2013.01); *F04B 23/02* (2013.01); *F04B 43/0054* (2013.01); *F04B 43/0081* (2013.01); *F04B 43/04* (2013.01); *F04B 43/1238* (2013.01)

(58) Field of Classification Search

CPC ..... F04B 13/00; F04B 17/03; F04B 23/02; F04B 43/0054; F04B 43/0081; F04B 43/1238; F04B 43/04; A47K 5/14; A47K 5/1215; A47K 5/1217

See application file for complete search history.

(56) References Cited

U.S. PATENT DOCUMENTS

| | | | | |
|---|---|---|---|---|
| 7,374,066 | B2 * | 5/2008 | Jackson | A47K 5/1217 222/190 |
| 8,172,555 | B2 * | 5/2012 | Reynolds | A47K 5/1208 222/207 |
| 8,485,395 | B2 | 7/2013 | Ciavarella et al. | |

(Continued)

*Primary Examiner* — Frederick C Nicolas
(74) *Attorney, Agent, or Firm* — Calfee, Halter & Griswold LLP

(57) ABSTRACT

An exemplary refill unit for a foam dispenser includes a container for holding a foamable liquid and a liquid pump connected to the container and an outlet nozzle. The liquid pump has a rigid back plate and a flexible membrane. The flexible membrane and the rigid back plate form an arcuate shaped liquid pump chamber. The rigid back plate has a liquid inlet located proximate a first end of the arcuate shaped pump chamber and a liquid outlet located proximate a second end of the arcuate shaped pump chamber. The liquid pump is actuated by progressive compression of the flexible membrane against the back plate.

20 Claims, 9 Drawing Sheets

(56) References Cited

U.S. PATENT DOCUMENTS

| | | | | |
|---|---|---|---|---|
| 8,544,698 | B2 * | 10/2013 | Ciavarella | A47K 5/14 222/145.5 |
| 8,622,242 | B2 * | 1/2014 | Pelfrey | A47K 5/1217 222/181.3 |
| 8,740,019 | B1 * | 6/2014 | Ciavarella | A47K 5/1215 222/129.1 |
| 8,827,119 | B2 * | 9/2014 | Ciavarella | B65D 83/00 222/181.1 |
| 8,827,179 | B2 * | 9/2014 | Arik | F23D 14/48 239/102.1 |
| 9,033,193 | B2 * | 5/2015 | Dong | B65D 47/248 220/258.2 |
| 9,089,860 | B2 | 7/2015 | Quinlan et al. | |
| 9,172,266 | B2 | 10/2015 | Curtis et al. | |
| 2005/0258192 | A1 * | 11/2005 | Matthews | A47K 5/14 222/190 |
| 2012/0248149 | A1 * | 10/2012 | Pelfrey | B67D 1/108 222/214 |
| 2014/0054323 | A1 * | 2/2014 | McNulty | A47K 5/14 222/190 |
| 2014/0061245 | A1 * | 3/2014 | McNulty | A47K 5/14 222/190 |
| 2014/0234140 | A1 | 8/2014 | Curtis et al. | |

* cited by examiner

ROTARY PERISTALTIC DOME PUMP

RELATED APPLICATIONS

This application claims priority to and the benefits of U.S. Provisional Patent Application titled Rotary Peristaltic Dome Pump, Ser. No. 62/245,629, filed on Oct. 23, 2015 and which is incorporated herein in its entirety by reference.

TECHNICAL FIELD

The present invention relates generally to dispenser systems, such as soap and sanitizer dispensers and refill units.

BACKGROUND OF THE INVENTION

Dispensing systems, such as soap and sanitizer dispensers, provide a user with a predetermined amount of liquid or foam soap or sanitizer upon actuation of the dispenser.

SUMMARY

Exemplary embodiments of dispensers, refill units, and pumps with variable output are disclosed herein.

An exemplary refill unit for a foam dispenser includes a container for holding a foamable liquid and a liquid pump connected to the container and an outlet nozzle. The liquid pump has a rigid back plate and a flexible membrane. The flexible membrane and the rigid back plate form an arcuate shaped liquid pump chamber. The rigid back plate has a liquid inlet located proximate a first end of the arcuate shaped pump chamber and a liquid outlet located proximate a second end of the arcuate shaped pump chamber. The liquid pump is actuated by progressive compression of the flexible membrane against the back plate.

Another exemplary refill unit for a foam dispenser includes a container for holding a foamable liquid and a pump housing connected to the container. The pump housing has a back plate, a flexible membrane, and an outlet nozzle. The flexible membrane has a base that is accepted in a groove of the back plate. An arcuate shaped pump chamber is formed at least in part by the back plate and the flexible membrane. The arcuate shaped pump chamber includes a liquid inlet in the first end of the arcuate shaped pump chamber and a liquid outlet located in the second end of the arcuate shaped pump chamber. A liquid outlet valve is located in the liquid outlet, and an outlet nozzle extends from the liquid outlet. A foaming media is located at least partially in the outlet nozzle. One or more air inlet apertures are located downstream of the liquid outlet and upstream of the foaming media.

Still another exemplary refill unit includes a container, a pump housing, a vent valve in the pump housing to vent the container, a rigid back plate, and a flexible membrane. The flexible membrane has a raised portion and a base portion. The base portion of the flexible membrane is secured to the rigid back plate. The raised portion of the flexible membrane forms an arcuate shaped pump chamber between the flexible membrane and the rigid back plate. A mixing chamber is included downstream of the arcuate shaped pump chamber and an outlet nozzle.

An exemplary foam dispenser includes a housing, an air pump secured to the housing and an actuating mechanism secured to the housing. The actuating mechanism has a swipe gear secured to a motor. A refill unit is installed in the dispenser that has a container and a pump secured to the container. The pump has a flexible membrane and a back plate that form an arcuate pump chamber and an outlet nozzle. The swipe gear compresses the arcuate pump chamber only during actuation of the pump.

Another foam dispenser includes a housing. An air pump and an actuating mechanism are secured to the housing. The actuating mechanism has a swipe gear secured to a motor. A refill unit is installed in the dispenser. The refill unit includes a container and a liquid pump secured to the container. The liquid pump has a flexible membrane and a back plate that form an arcuate pump chamber and an outlet nozzle. The swipe gear compresses the arcuate pump chamber only during actuation of the pump. The motor drives both the liquid pump and the air pump.

BRIEF DESCRIPTION OF THE DRAWINGS

These and other features and advantages of the present invention will become better understood with regard to the following description and accompanying drawings in which.

DETAILED DESCRIPTION

Figure 1:
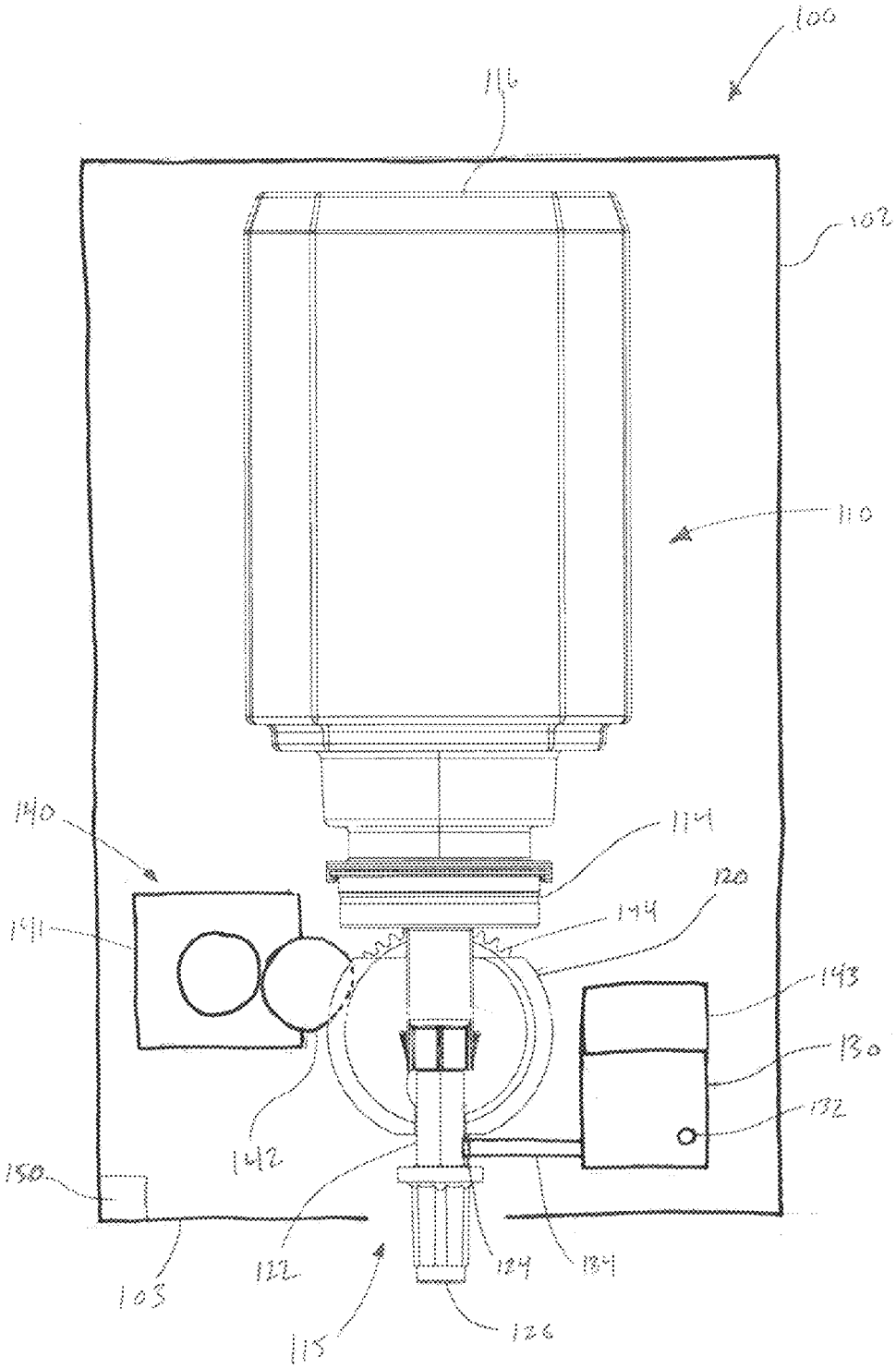
FIG. 1 is a cross-section of an exemplary dispenser system having a refill unit.

FIG. 1 illustrates an exemplary embodiment of a foam dispenser 100. The cross-section of FIG. 1 is taken through the housing 102 to show a liquid pump 120, an air pump 130, a container 116, and an actuator 140. The dispenser 100 includes a disposable refill unit 110. The disposable refill unit 110 includes container 116, liquid pump 120, premix chamber 122, and outlet nozzle 126. The dispenser 100 may be a wall-mounted system, a counter-mounted system, an un-mounted portable system movable from place to place, or any other kind of dispenser system. The dispenser 100 can be configured to pump liquid only with the air pump 130 removed or deactivated. Other components may also be removed for use with liquid dispensers only.

Figure 2A:
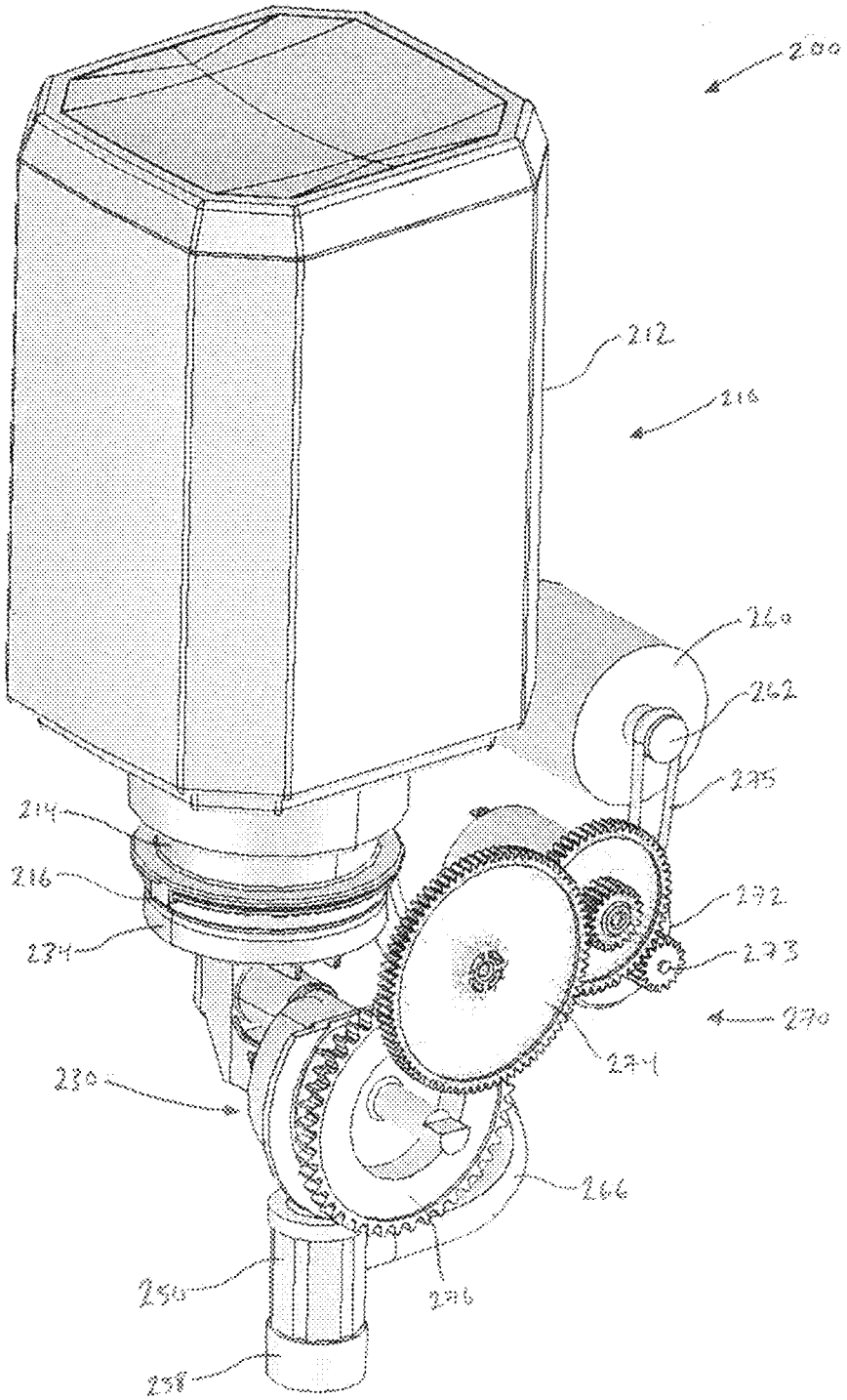
FIG. 2A is a perspective view of an exemplary refill unit and actuation drive system.
Figure 2B:
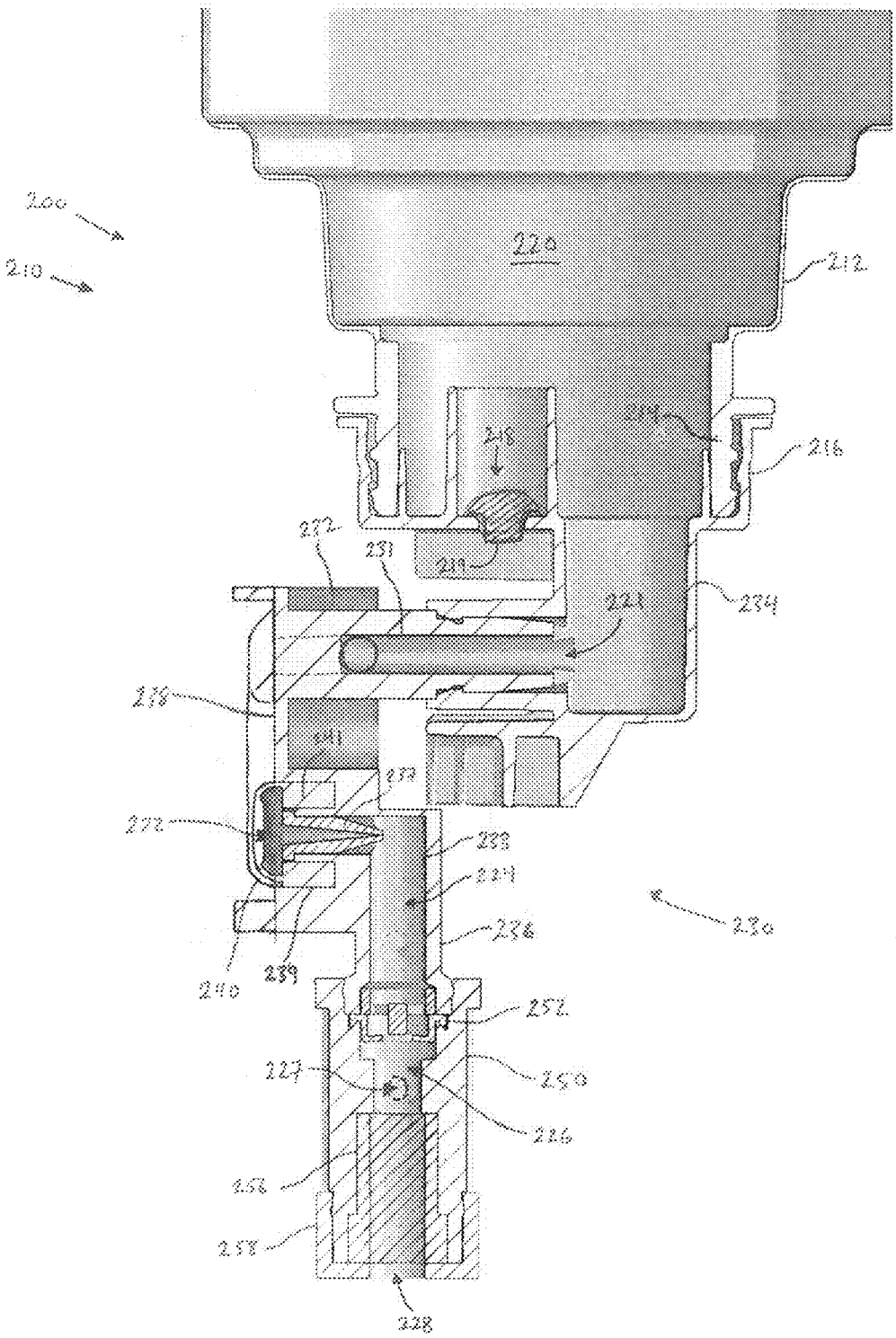
FIG. 2B is a partial cross-section of the refill unit of FIG. 2A.

The container 116 forms a liquid reservoir that contains a supply of dispensable liquid within the disposable refill unit 110. In various embodiments, the contained liquid could be for example a soap, a sanitizer, a cleanser, a disinfectant, a lotion, a foamable liquid, or other dispensable liquid. In the exemplary disposable refill unit 110, the container 116 is formed by a rigid housing member. A vent (not shown) to vent the container 116 is included. A vent (not shown) may be included in a wall of the container, or may be included in the pump 120 connected to the container (e.g. vent port 218 and vent valve 219 of FIG. 2B). In other embodiments, the container 116 may be formed by a collapsible container and can be made of thin plastic or a flexible bag-like material, or have any other suitable configuration for containing the liquid without leaking. A vent is not needed with a collapsible container.

The container 116 may advantageously be refillable, replaceable or both refillable and replaceable. In the event the liquid stored in the container 116 of the installed disposable refill unit 110 runs out, or the installed refill unit 110 otherwise has a failure, the installed refill unit 110 may be removed from the dispenser 100. The empty or failed disposable refill unit 110 may then be replaced with a new disposable refill unit 110.

The refill unit 110 includes the liquid pump 120 that is in fluid communication with the container 116. A collar 114 secures the liquid pump 120 to the container 116. The collar 114, which may be a separate component or may be an integrally formed part of the liquid pump 120, may secure the liquid pump 120 to the container 116 by any means, such as, for example, a threaded connection, a welded connection, a quarter turn connection, a snap fit connection, a clamp connection, a flange and fastener connection, or the like.

The outlet of the liquid pump 120 is in fluid communication with a premix chamber 122 that also receives air from the air pump 130 through an air delivery tube 134. The premix chamber 122 is in fluid communication with an outlet nozzle 126.

In some embodiments, the liquid pump 120, premix chamber 122, and outlet nozzle 126 are part of the refill unit 110 and may be disposed of upon depletion of the liquid from the container 116. The air pump 130 and air delivery tube 134 are secured to the dispenser 100 and are not disposed of while replacing the refill unit 110. The concept of having a foam pump that has a liquid pump portion separable from an air pump portion may be referred to as a "split pump." Exemplary split pumps are shown and described in U.S. Pat. No. 9,089,860 entitled "Bifurcated Foam Pump, Dispenser, and Refill Units", which is incorporated herein by reference in its entirety. The air pump 130 is generically illustrated because there are many different kinds of air pumps which may be employed in dispenser 100. Air pump 130 may be any type of air pump, such as a rotary pump, a piston pump, a fan pump, a turbine pump, a pancake pump, a diaphragm pump, or the like.

In some embodiments, the refill unit 110 includes projections (not shown) that interface with a rotatable retention ring (not shown) on the interior of the housing 102. These projections secure the refill unit 110 within the housing 102 and retain the liquid pump 120 in contact with an actuation assembly 144 of actuator 140 when the refill unit 110 is installed in the dispenser 100. The retention ring is rotated to remove the refill unit 110 from the dispenser 100. An exemplary embodiment is shown and described in U.S. Pat. No. 8,485,395 entitled "Dispenser Lock Out Mechanism", which is incorporated herein by reference in its entirety. The refill unit 110 may be secured within the dispenser 100 by other means, such as, for example, a quarter turn connection, a threaded connection, a flange and fastener connection, a clamped connection, or any other releasable connection. In some embodiments, components of the actuator 140, such as actuation assembly 144, may be part of the refill unit 110. In fact, many of the components of the actuator 140 may be part of the dispenser 100 or be part of the refill unit 110. The actuation assembly 144 includes a swipe gear (not shown) similar to those described below and liquid pump 120 is similar to the liquid pumps described below.

The dispenser 100 also includes a sensor 150 for detecting a users hand, a processor and memory (not shown), and a power source (not shown) such as one or more batteries. The dispenser 100 may include a power system, such as that described in U.S. Published Patent Application No. 2014/0234140 entitled "Power Systems for Touch Free Dispensers and Refill Units Containing A Power Source", which is incorporated herein by reference in its entirety.

During operation of the dispenser 100, upon detection of a hand by sensor 150 foamable liquid is pumped from the container 116 by the liquid pump 120 into the premix chamber 122. Simultaneously, air is drawn into the air pump 130 through an air inlet 132 and is pumped through the air delivery tube 134 into the air inlet 124 of the premix chamber 122 to mix with the liquid. The air and liquid mixture is then forced through foaming media (not shown) to dispense rich foam from the nozzle 126. In one embodiment, foaming media includes one or more screens that generate high quality foam. Foaming media may also include porous members, sponges, baffles, or the like. An aperture 115 in a bottom plate 103 of the housing 102 allows foam dispensed from the nozzle 126 to exit the housing 102 for use by the user.

The dispenser 100 contains one or more actuators 140 to activate the liquid pump 120 and the air pump 130. As used herein, actuator, actuating members, or mechanism includes one or more parts that cause the dispenser 100 to move liquid, air or foam. Different actuators may activate the liquid pump 120 and air pump 130, or one actuator may be used to activate both the liquid pump 120 and air pump 130. In some embodiments, the actuator 140 includes an electric motor 141 that turns a drive train 142 (such as one or more gears as shown) that interfaces with the actuation assembly 144 that actuates the liquid pump 120 when turned. The electric motor 141 of actuator 140 may be an AC motor or a DC motor and may be powered by a standard electrical source, such as 115 VAC or by batteries. A second motor 143 activates the air pump 130 to pump air into the premix chamber 122 to generate foam. Although the actuators are shown as the electric motors 141, 143 for a hands-free dispenser system with touchless operation, they may be any kind of actuator capable of activating the liquid and air pumps 120, 130, such as a manual lever, a manual pull bar, a manual push bar, a manual rotatable crank, an electrically activated actuator, or other means for actuating the liquid pump 120 and air pump 130.

The air pump 130 and actuators 140 may be connected to the housing 102 by any means. In an exemplary split pump embodiment, the electronics (not shown), air pump 130, air delivery tube 134, and actuators 140 are part of a pump house (not show) that is attached to the housing 102. Assembling these components into the pump house allows for easier assembly of the dispenser 100 and ensures alignment of the components.

FIGS. 2A, 2B, 2C, and 2D illustrate an exemplary embodiment of a refill unit 210 and actuation drive system of an exemplary dispenser 200. The dispenser 200 includes a housing, a sensor, batteries, and circuitry that are not shown for clarity. The refill unit 210 is removable from the dispenser 200 and includes a container 212, a liquid pump 230, and a nozzle 250. The dispenser 200 includes an air pump 260 and an actuation assembly 270 for actuating the liquid and air pumps 230, 260. In some embodiments, both the air pump 260 and liquid pump 230 of the dispenser 200 may be included in the refill unit 210. When arranged as a split pump, the air pump 260 is secured to the dispenser 200 and is not removed when the dispenser 200 is refilled by replacing the refill unit 210. The actuation assembly 270 may also be included in the refill unit 210 or may be secured to the dispenser 200.

The interior of the container 212 forms a reservoir 220 for holding foamable liquid. A neck 214 of the container 212 is received within a collar 216 of a container closure 234. When the collar 216 is connected to the neck 214 of the container 212, a liquid tight seal is formed between the closure 234 and the container 212. The collar 216 may be connected to the container 212 by any means, such as, for example, a threaded connection, a welded connection, an adhesive connection, a snap fit connection, a friction fit connection, a quarter turn connection, or the like. The container 212 is non-collapsing and is formed by a semi-rigid plastic. The container 212 is vented through a vent valve 219 in a vent port 218 of the container closure 234. In some embodiments, the container 212 is be formed by a collapsible container and can be made of thinner plastic or a flexible bag-like material, or have any other suitable configuration for containing the liquid without leaking and does not need a vent.

Figure 2C:
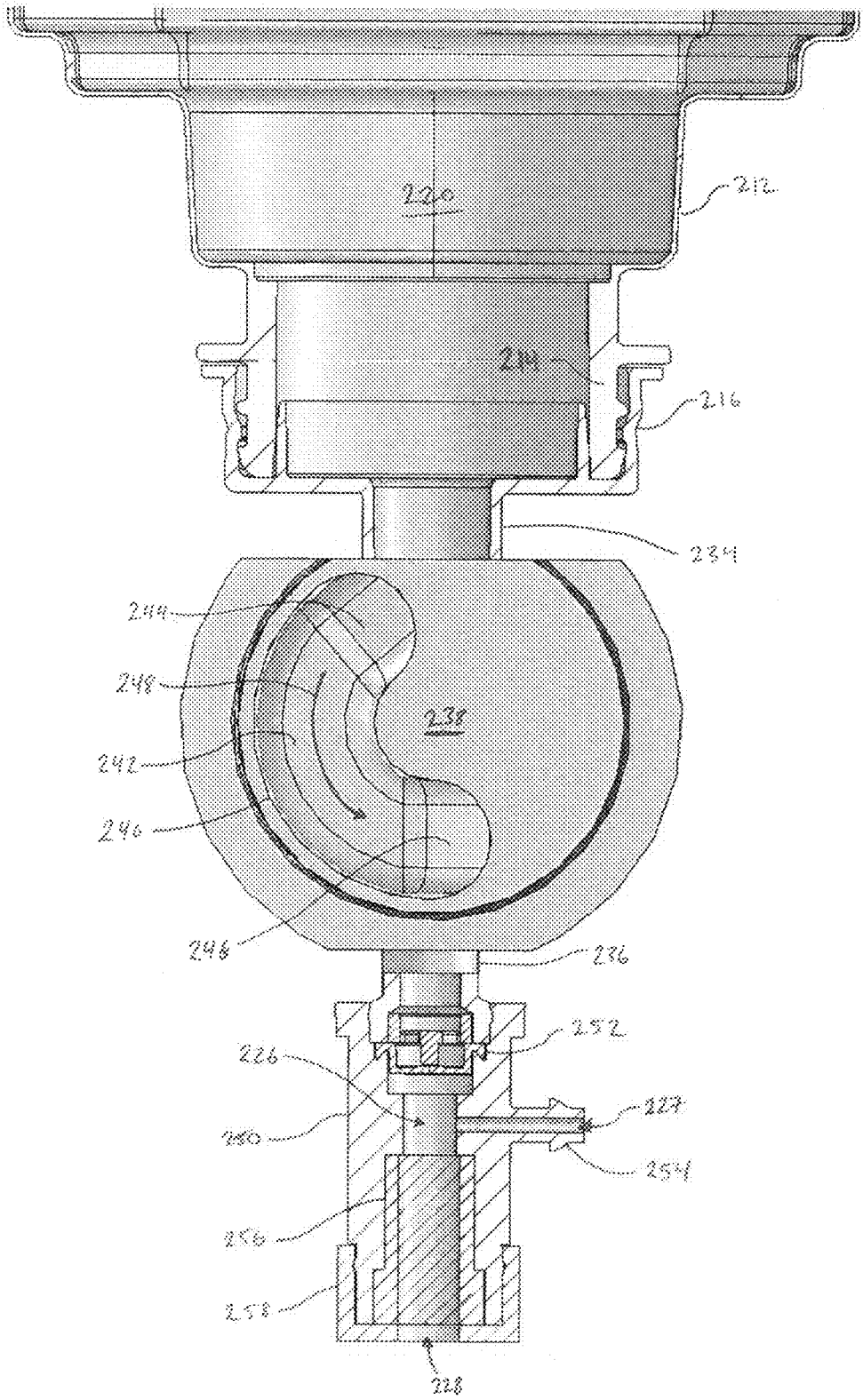
FIG. 2C is a partial cross-section of the refill unit of FIG. 2A.
Figure 2D:
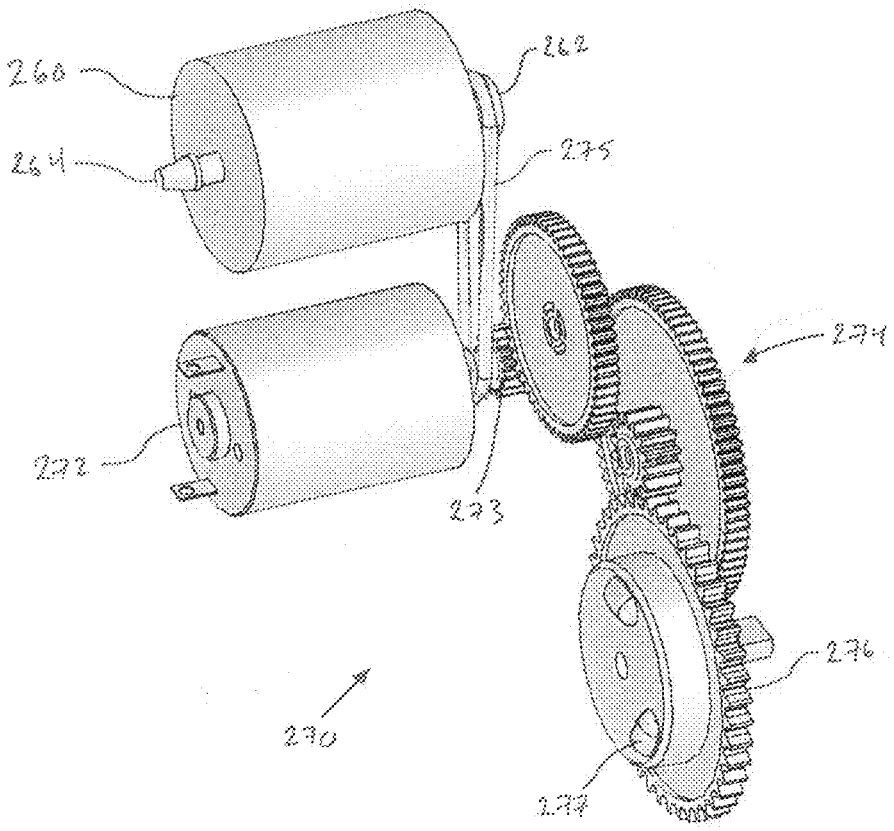
FIG. 2D is a perspective view of the actuation drive assembly of FIG. 2A.

The liquid pump 230 includes a pump body 232 and a semi-annular flexible actuation membrane 240 which is best seen in FIG. 2C. The pump body 232 is connected to container closure 234 and the two are shown as separate components in FIG. 2B, but may also be formed integrally as a single component. The pump body 232 has an outlet 236 and a rigid back plate 238. The flexible actuation membrane 240 has a base 241, a resilient actuation portion 242, a first end 244, a second end 246, and a direction of actuation 248. In some embodiments first end 244 has a surface that slopes upward to the top of the flexible actuation membrane 240. In some embodiments second end 244 has a surface that slopes downward from the top of the flexible actuation membrane 240.

A groove 239 in the back plate 238 receives the base 241 of the flexible actuation member 240 forming an arcuate pump chamber 222 between the actuation membrane 240 and the back plate 238. A liquid tight seal is formed between the base 241 of the actuation membrane 240 and the groove 239 of the back plate 238. The flexible actuation membrane 240 and pump body 232 may be held together by any means, such as, for example, an adhesive, a friction fit connection, a projection and groove connection, through the use of another component to mechanically restrain the component, or the like. The flexible actuation membrane 240 may be made of any suitable flexible material, such as, for example, latex rubber, polyisoprene, TPE, silicone, EPDM rubber, nitrile rubber, or the like. In some embodiments the flexible actuation membrane 240 has a Shore D hardness of between about 30 and 60 durometer.

A fluid passage 231 extends from inlet 221 through the container closure 234 and pump body 232 to fluidly connect the reservoir 220 and the pump chamber 222. An outlet passage 233 extends through the portion 236 of pump housing 232 to fluidly connect the pump chamber 222 to a premix chamber 226 in the nozzle 250. A one-way outlet valve 237 is disposed in the pump housing 232 downstream of pump chamber 222. One-way outlet valve 237 prevents fluid from flowing up into the pump chamber 222 and container 212. It also helps prevent liquid from leaking out of the refill unit 210 during storage. The one-way outlet valve 237 is shown as a duck-bill valve but may be any kind of one-way valve, such as, for example, a ball and spring valve, a poppet valve, a flapper valve, an umbrella valve, a slit valve, a mushroom valve, or the like. In some embodiments, one-way outlet valve 237 reduces the volume of the pump chamber 222 to increase the efficiency of the pump.

In some embodiments, the outlet nozzle 250 includes a pump outlet valve 252, an air inlet 254, foaming media 256, and an end cap 258. The nozzle 250 is attached to the outlet portion 236 of pump housing 232 by any means, such as, for example, a threaded connection, a welded connection, an adhesive connection, a snap fit connection, a friction fit connection, a quarter turn connection, or the like. The outlet valve 252 is retained against the outlet portion 236 by the nozzle 250 and may be any kind of one-way valve, such as, for example, a ball and spring valve, a poppet valve, a flapper valve, an umbrella valve, a slit valve, a mushroom valve, a duck bill valve, or the like. The foaming media 256 is retained within the nozzle 250 by the end cap 258 and includes at least one mix media that generates high quality foam, such as, for example, one or more screens, porous members, sponges, baffles, or the like or combinations thereof. Foam is dispensed through a nozzle outlet 228 of the nozzle 250. The end cap 258 is attached to the nozzle 250 by any means, such as, for example, a threaded connection, a welded connection, an adhesive connection, a snap fit connection, a friction fit connection, a quarter turn connection, or the like. In some embodiments any one of the outlet valves 237, 252 are not used.

The air pump 260 includes an actuation shaft 262 and an air pump outlet 264. The air pump 260 is connected to the nozzle 250 by an air delivery tube 266. The air delivery tube 266 attaches to the air pump outlet 264 of the air pump 260 and an air inlet 254 of the nozzle 250. An air inlet passageway 227 extends through the air inlet 254 to fluidly connect the air pump 260 to the premix chamber 226. A one-way valve (not shown) may optionally be included in the air inlet 254 to prevent back flow of fluid from the premix chamber 226 if, for example, the nozzle outlet 228 of the refill unit 210 becomes clogged.

The actuation assembly 270 includes a motor 272, a first drive train 274, a second drive train 275, and a swipe gear 276. In the illustrated embodiment, the motor 272 is an electric motor and may be an AC motor or a DC motor and may be powered by a standard electrical source, such as 115 VAC outlets or by batteries. The motor 272 has a drive shaft 273 that connects to the first and second drive trains 274, 275. The first drive train 274 transmits power from the motor 272 to the swipe gear 276 to actuate the liquid pump 230. The second drive train 275 transmits power from the motor 272 to the actuation shaft 262 of the air pump 260 to actuate the air pump 260. The first drive train 274 also reduces the rotational speed of the motor 272 that is transmitted to the swipe gear 276 so that more than one rotation of the drive shaft 273 is required to rotate the swipe gear 276 through a complete rotation. In the illustrated embodiments, the first drive train 274 is a series of gears and the second drive train 275 is a flexible belt. In some embodiments, gears are used for both the first and second drive trains 274, 275. Alternatively, two different motors (not shown) may be used to actuate the liquid and air pumps 230, 260.

When the refill unit 210 is installed in the dispenser 200 the liquid pump 230 is positioned so that rotation of the swipe gear 276 in the direction of actuation 248 will cause the swipe projections 277 to compress the actuation portion 242 and wipe across the actuation portion 242 of the actuation membrane 240, and therefore, the pump chamber 222. The first end 242 and second end 244 of the flexible actuation membrane 240 are rounded and/or tapered to provide a smooth transition for a swiping projections 277 of a swipe gear 276 during actuation of the liquid pump 230. In some embodiments, projections 277 are formed as part of swipe gear 276. In some embodiments, projections 277 are one or more rollers. In some embodiments, projections 277 have a sloped surface. In some embodiments, there are two projections 277. In some embodiments, there are more than two projections 277. As the swipe gear 276 is rotated, the swiping projections 277 progressively compress the actuation portion 242 of the actuation membrane 240 against the back plate 238 of the pump body 232 causing liquid in the pump chamber 222 to be forced through the outlet valve 237 into the outlet 224. The actuation portion 242 of the membrane 240 expands to its original uncompressed position behind each swipe projection 277, causing the pump chamber 222 to increase in volume, drawing in liquid from the reservoir 220 through the inlet 221. As described above, the chamber valve 237 prevents fluid from leaking out of the pump chamber 222 when the membrane 240 is not compressed. In some embodiments, in between actuation cycles, the swipe projections 277 of the swipe gear 276 do not engage the actuation membrane 240. This allows the actuation membrane 240 to be made from thermoplastic materials rather than thermoset materials. In some embodiments, one or more projections 277 always compress a portion of pump chamber 222 and the outlet valve(s) may not be needed.

Rotation of the swipe gear 276 pushes liquid past the outlet valve 252 and into the premix chamber 226. Simultaneously, the motor 272 causes the drive shaft 262 of the air pump 260 to rotate, pumping air through the air delivery tube 266 into the premix chamber 224 through the air inlet passageway 227.

The liquid flow rate from the liquid pump 230 may be different than the air flow rate of the air pump 260. In some embodiments, the air to liquid ratio between the two pumps may be between about 1 to 1 and about 20 to 1, for example, the air to liquid ratio may be about 15 to 1, 10 to 1, 8 to 1, or 5 to 1. Continued actuation of the dispenser forces the air and liquid mixture out of the premix chamber 226 through the foaming media 256 to generate and dispense rich foam from the nozzle outlet 228.

FIGS. 3A, 3B, 3C, and 3D illustrate an exemplary embodiment of a dispenser system 300, a refill unit 310, and an actuator drive assembly. The dispenser 300 includes a housing, a sensor, batteries, and circuitry that are not shown for clarity. The refill unit 310 is removable from the dispenser 300 and includes a container 312, a liquid pump 330, and a nozzle 350. The liquid pump 330 is oriented in a generally horizontal direction, in contrast to the vertically oriented liquid pump 230 described above. The dispenser includes an air pump 360 and an actuation assembly 370 for actuating the liquid and air pumps 330, 360. In some embodiments, both the air pump 360 and liquid pump 330 of the dispenser 300 may be included in the refill unit 310. When arranged as a split pump, the air pump 360 is secured to the dispenser 300 and is not removed when the dispenser 300 is refilled by replacing the refill unit 310. The actuation assembly 370 may also be included in the refill unit 310 or may be secured to the dispenser 300.

The interior of the container 312 forms a reservoir 320 for holding foamable liquid. A neck 314 of the container 312 is received within a collar 316 of a container closure 334. When the collar 316 is connected to the neck 314 of the container 312, a liquid tight seal is formed between the closure 334 and the container 312. The collar 316 may be connected to the container 312 by any means, such as, for example, a threaded connection, a welded connection, an adhesive connection, a snap fit connection, a friction fit connection, a quarter turn connection, or the like. The container 312 is non-collapsing and is formed by a semi-rigid plastic. The container 312 is vented through a vent valve 319 in a vent port 318 of the container closure 334. In some embodiments, the container 312 is be formed by a collapsible container and can be made of thinner plastic or a flexible bag-like material, or have any other suitable configuration for containing the liquid without leaking and does not need a vent.

Figure 3A:
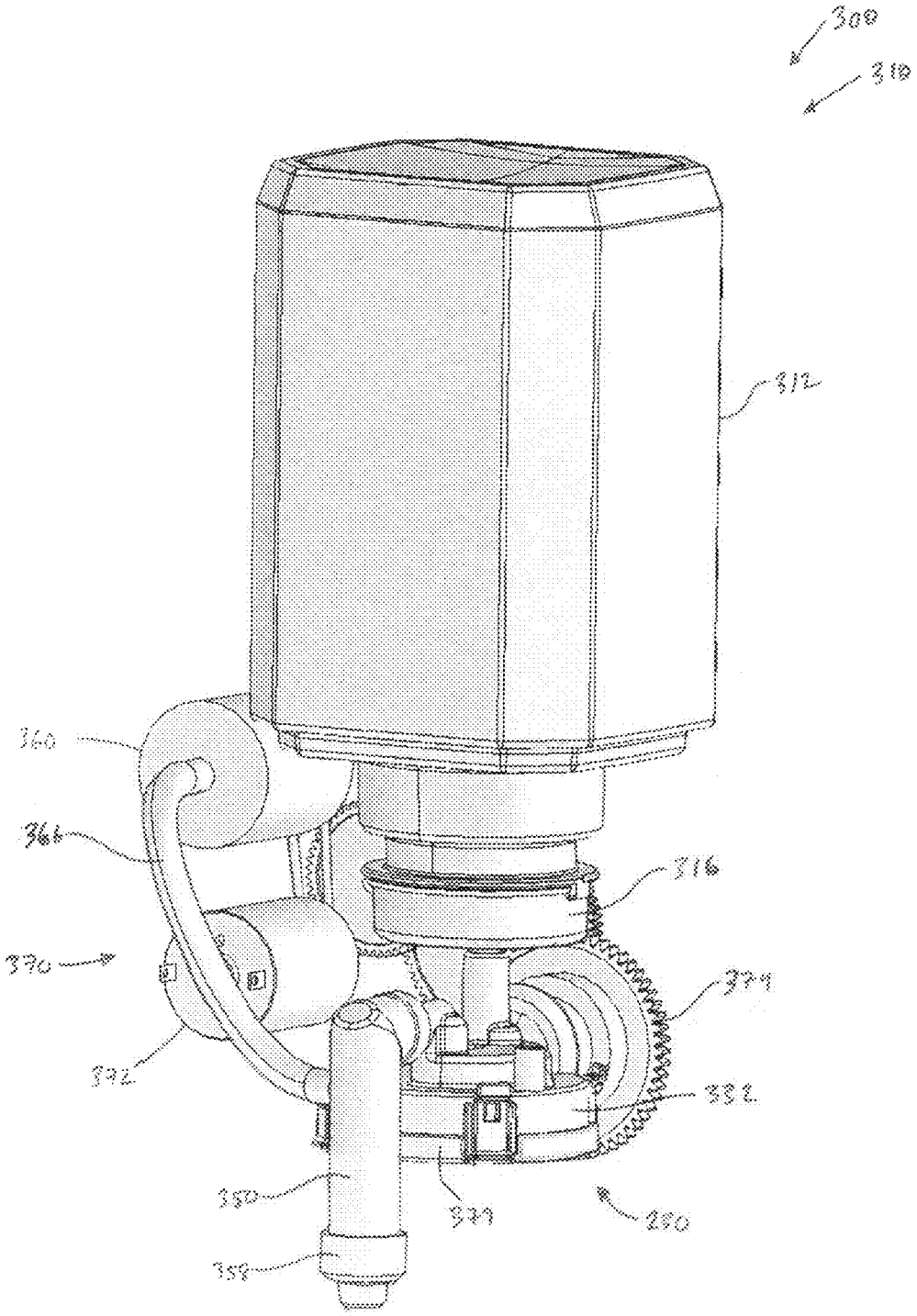
FIG. 3A is a perspective view of an exemplary dispenser system having a refill unit with the housing removed.
Figure 3B:
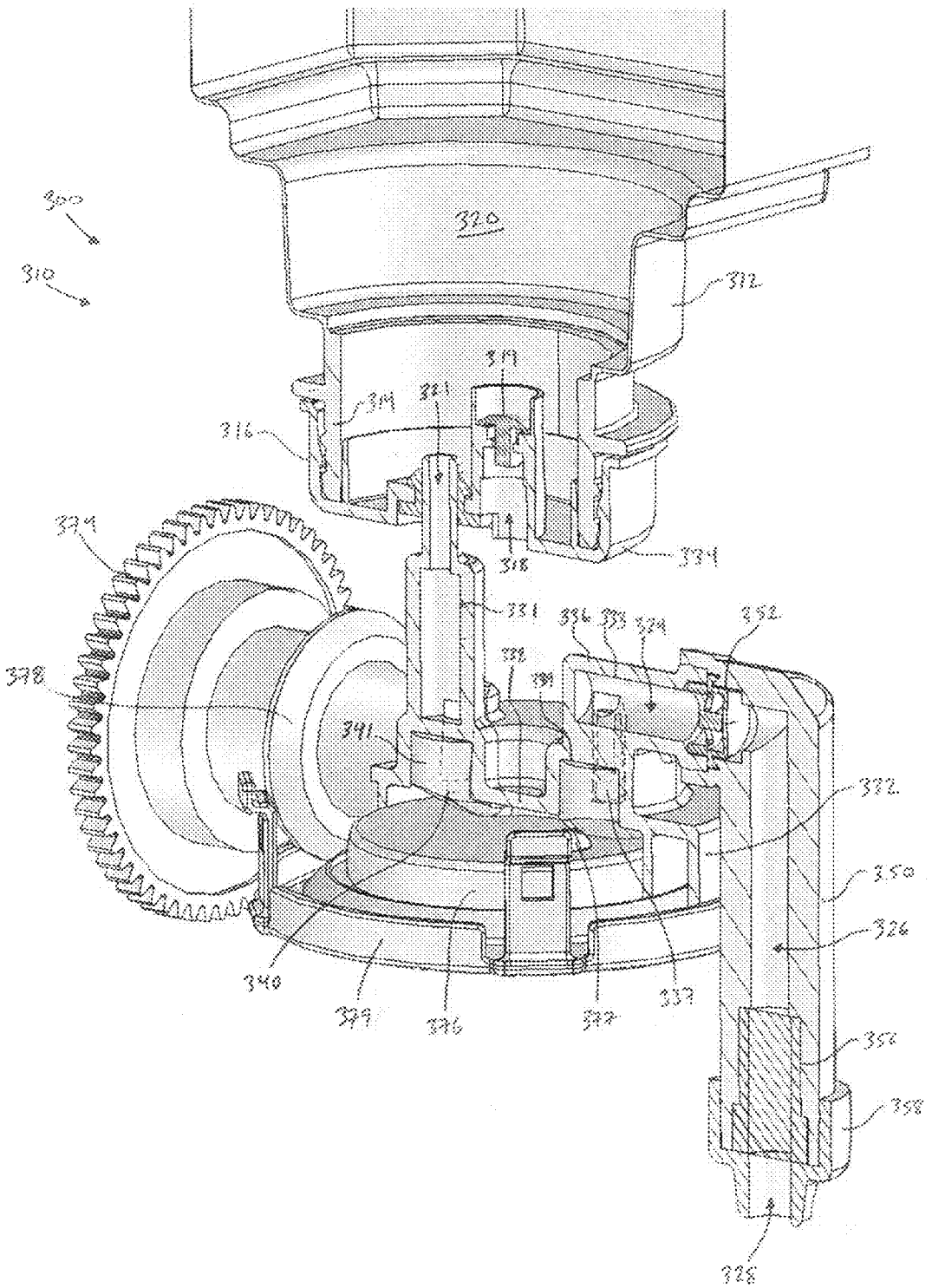
FIG. 3B is a partial cross-section of the refill unit of FIG. 3A.
Figure 3C:
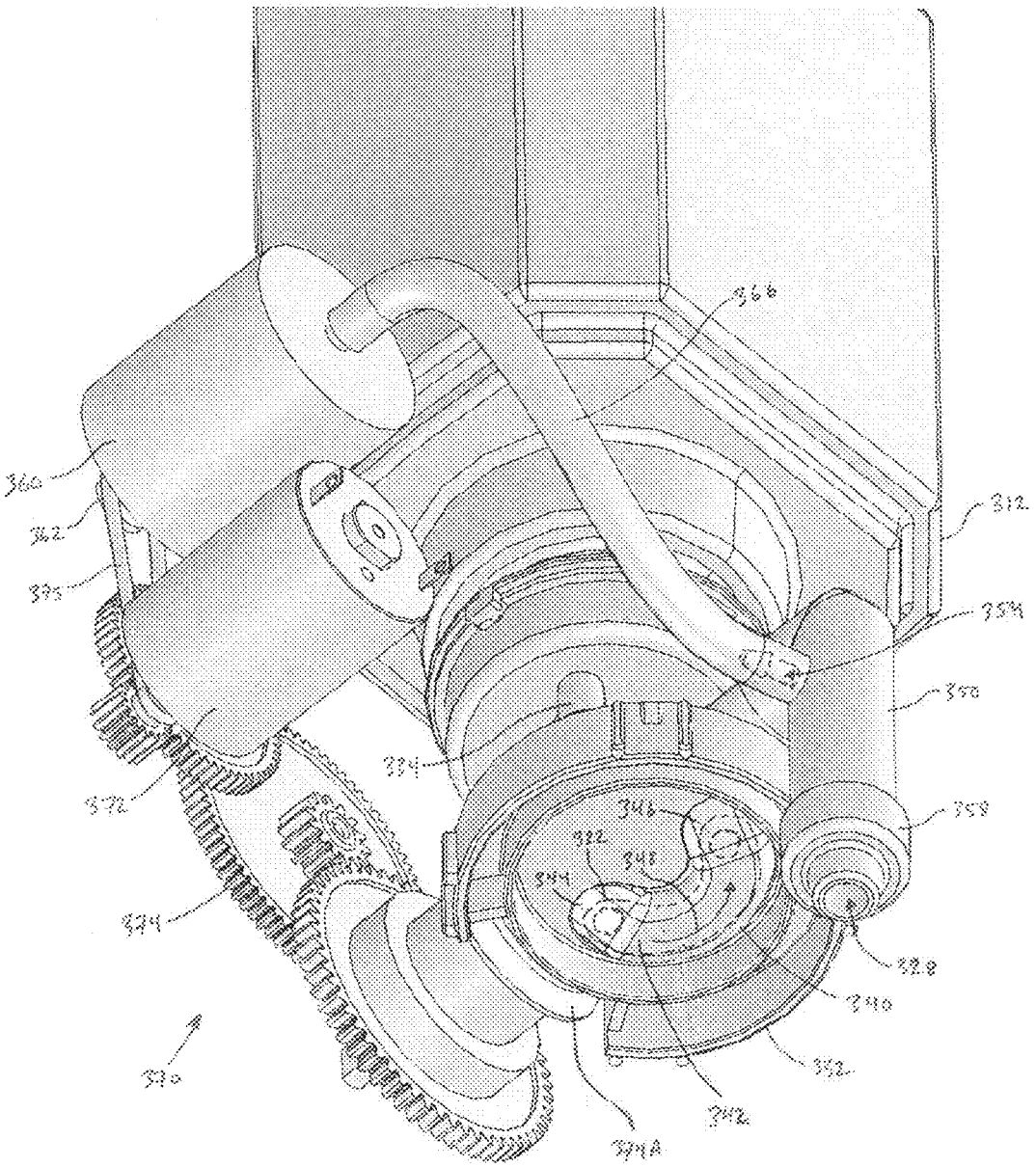
FIG. 3C is a partial perspective view of the dispenser and refill unit of FIG. 3A with the swipe gear removed.
Figure 3D:
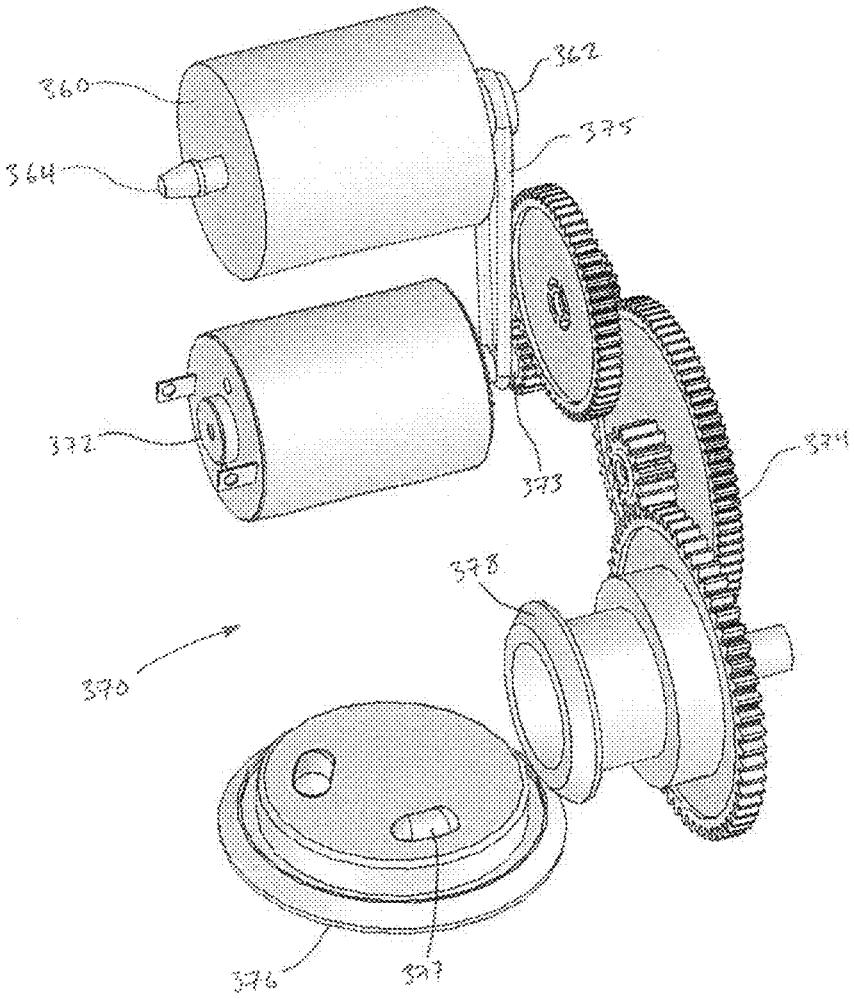
FIG. 3D is a partial perspective view of an actuator drive assembly and the swipe gear that was not shown in FIG. 3C.

The liquid pump 330 includes a pump body 332 and a semi-annular flexible actuation membrane 340 which is best seen in FIG. 3C. The pump body 332 is connected to container closure 334 and the two are shown as separate components in FIG. 3B, but may also be formed integrally as a single component. The pump body 332 has an outlet 336 and a rigid back plate 338. The flexible actuation membrane 340 has a base 341, a resilient actuation portion 342, a first end 344, a second end 346, and a direction of actuation 348.

A groove 339 in the back plate 338 receives the base 341 of the flexible actuation member 340 forming an arcuate pump chamber 322 (FIG. 3C) between the actuation membrane 340 and the back plate 338. A liquid tight seal is formed between the base 341 of the actuation membrane 340 and the groove 339 of the back plate 338. The flexible actuation membrane 340 and pump body 332 may be held together by any means, such as, for example, an adhesive, a friction fit connection, a projection and groove connection, through the use of another component to mechanically restrain the component, or the like. The flexible actuation membrane 340 may be made of any suitable flexible material, such as, for example, latex rubber, polyisoprene, TPE, silicone, EPDM rubber, nitrile rubber, or the like. In some embodiments the flexible actuation membrane 340 has a Shore D hardness of between about 30 and 60 durometer.

A fluid passage 331 extends from inlet 321 through the container closure 334 and pump body 332 to fluidly connect the reservoir 320 and the pump chamber 322. An outlet passage 333 extends through the portion 336 of pump housing 332 to fluidly connect the pump chamber 322 to a premix chamber 326 in the nozzle 350. A one-way outlet valve 337 is disposed in the pump housing 332 downstream of pump chamber 322. One-way outlet valve 337 prevents fluid from flowing up into the pump chamber 322 and container 312. It also helps prevent liquid from leaking out of the refill unit 310 during storage. The one-way outlet valve 337 is shown as a duck-bill valve but may be any kind of one-way valve, such as, for example, a ball and spring valve, a poppet valve, a flapper valve, an umbrella valve, a slit valve, a mushroom valve, or the like. In some embodiments, one-way outlet valve 337 reduces the volume of the pump chamber 322 to increase the efficiency of the pump.

In some embodiments, the outlet nozzle 350 includes a pump outlet valve 352, an air inlet 354, foaming media 356, and an end cap 358. The nozzle 350 is attached to the outlet portion 336 of pump housing 332 by any means, such as, for example, a threaded connection, a welded connection, an adhesive connection, a snap fit connection, a friction fit connection, a quarter turn connection, or the like. The outlet valve 352 is retained against the outlet portion 336 by the nozzle 350 and may be any kind of one-way valve, such as, for example, a ball and spring valve, a poppet valve, a flapper valve, an umbrella valve, a slit valve, a mushroom valve, a duck bill valve, or the like. The foaming media 356 is retained within the nozzle 350 by the end cap 358 and includes at least one mix media that generates high quality foam, such as, for example, one or more screens, porous members, sponges, baffles, or the like or combinations thereof. Foam is dispensed through a nozzle outlet 328 of the nozzle 350. The end cap 358 is attached to the nozzle 350 by any means, such as, for example, a threaded connection, a welded connection, an adhesive connection, a snap fit connection, a friction fit connection, a quarter turn connection, or the like. In some embodiments any one of the outlet valves 337, 353 are not used.

The air pump 360 includes an actuation shaft 362 and an air pump outlet 364. The air pump 360 is connected to the nozzle 350 by an air delivery tube 366. The air delivery tube 366 attaches to the air pump outlet 364 of the air pump 360 and an air inlet 354 of the nozzle 350. An air inlet passageway 327 extends through the air inlet 354 to fluidly connect the air pump 360 to the premix chamber 326. A one-way valve (not shown) may optionally be included in the air inlet 354 to prevent back flow of fluid from the premix chamber 326 if, for example, the nozzle outlet 328 of the refill unit 310 becomes clogged.

The actuation assembly 370 includes a motor 372, a first drive train 374, a second drive train 375, and a swipe gear 376. In the illustrated embodiment, the motor 372 is an electric motor and may be an AC motor or a DC motor and may be powered by a standard electrical source, such as 115 VAC outlets or by batteries. The motor 372 has a drive shaft 373 that connects to the first and second drive trains 374, 375. The first drive train 374 transmits power from the motor 372 to the swipe gear 376 to actuate the liquid pump 330. The second drive train 375 transmits power from the motor 372 to the actuation shaft 362 of the air pump 360 to actuate the air pump 360. The first drive train 374 also reduces the rotational speed of the motor 372 that is transmitted to the swipe gear 376 so that more than one rotation of the drive shaft 373 is required to rotate the swipe gear 376 through a complete rotation. To accommodate the horizontal orientation of the liquid pump 330 and actuation membrane 340, a beveled gear 378 of the first drive train 275 engages a beveled portion of the horizontally oriented swipe gear 376. An annular housing 379 is also included to retain the swipe gear 376 against the actuation membrane 340. The annular housing 379 at least partially surrounds the actuation membrane 340 and the pump housing 332. In some embodiments, the annular housing 379 may be secured to the pump housing 332. In the illustrated embodiments, the first drive train 374 is a series of gears and the second drive train 375 is a flexible belt. In some embodiments, gears are used for both the first and second drive trains 374, 375. Alternatively, two different motors (not shown) may be used to actuate the liquid and air pumps 330, 360.

When the refill unit 310 is installed in the dispenser 300 the liquid pump 330 is positioned so that rotation of the swipe gear 376 in the direction of actuation 348 will cause the swipe projections 377 to compress the actuation portion 342 and wipe across the actuation portion 342 of the actuation membrane 340, and therefore, the pump chamber 322. The first end 342 and second end 344 of the flexible actuation membrane 340 are rounded and/or tapered to provide a smooth transition for a swiping protrusions 377 of a swipe gear 376 during actuation of the liquid pump 330. In some embodiments, protrusions 377 are rollers. As the swipe gear 376 is rotated, the swiping projections 377 progressively compress the actuation portion 342 of the actuation membrane 340 against the back plate 338 of the pump body 332 causing liquid in the pump chamber 322 to be forced through the outlet valve 337 into the outlet 324. The actuation portion 342 of the membrane 340 expands to its original uncompressed position behind each swipe projection 377, causing the pump chamber 322 to increase in volume, drawing in liquid from the reservoir 320 through the inlet 321. In some embodiments, in between actuation cycles, the swipe projections 377 of the swipe gear 376 do not engage the actuation membrane 340. As described above, the chamber valve 337 prevents fluid from leaking out of the pump chamber 322 when the membrane 340 is not compressed. This allows the actuation membrane 340 to be made from thermoplastic materials rather than thermoset materials. In some embodiments, one or more projections 377 always compress a portion of pump chamber 322 and the outlet valve(s) may not be needed.

Rotation of the swipe gear 376 pushes liquid past the outlet valve 352 and into the premix chamber 326. Simultaneously, the motor 372 causes the drive shaft 362 of the air pump 360 to rotate, pumping air through the air delivery tube 366 into the premix chamber 324 through the air inlet passageway 327.

The liquid flow rate from the liquid pump 330 may be different than the air flow rate of the air pump 360. In some embodiments, the air to liquid ratio between the two pumps may be between about 1 to 1 and about 20 to 1, for example, the air to liquid ratio may be about 15 to 1, 10 to 1, 8 to 1, or 5 to 1. Continued actuation of the dispenser forces the air and liquid mixture out of the premix chamber 326 through the foaming media 356 to generate and dispense rich foam from the nozzle outlet 328.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

What is claimed is:

1. A refill unit for a dispenser comprising:

a container for holding a liquid;

a liquid pump connected to the container and an outlet nozzle;

the liquid pump having a rigid back plate and a flexible membrane; and the flexible membrane and the rigid back plate forming an arcuate shaped liquid pump chamber;

wherein rigid back plate lies in a first plane;

wherein the arc of the arcuate shaped liquid pump chamber lies along a second plane substantially parallel to the first plane; and the rigid back plate having a liquid inlet located proximate a first end of the arcuate shaped pump chamber and a liquid outlet located proximate a second end of the arcuate shaped pump chamber;

wherein the liquid pump is actuated by progressive compressing the flexible membrane against the back plate along a path from the liquid inlet toward the liquid outlet.

2. The refill unit of claim 1 wherein fluid flowing through the arcuate shaped liquid pump chamber flows in a plane that is substantially perpendicular to a direction of fluid flow in the outlet nozzle.

3. The refill unit of claim 1 wherein the arcuate shaped liquid pump chamber is along a substantially horizontal axis and the outlet nozzle extends along a substantially vertical axis.

4. The refill unit of claim 1 wherein the arcuate shaped liquid pump chamber is along a bottom surface of the refill unit.

5. The refill unit of claim 1 wherein the arcuate shaped liquid pump chamber is along a side surface of the refill unit.

6. The refill unit of claim 1 wherein the refill unit further includes a vent valve to vent the container.

7. A refill unit for a foam dispenser comprising:
a container for holding a foamable liquid;
a pump housing connected to the container;
the pump housing having a back plate, a flexible membrane and an outlet nozzle;
the flexible membrane having a base;
the back plate having a groove for accepting the base of the flexible membrane;
an arcuate shaped pump chamber formed at least in part by the back plate and the flexible membrane;
a liquid inlet in a first end of the arcuate shaped pump chamber and a liquid outlet located in a second end of the arcuate shaped pump chamber;
a liquid outlet valve;
the outlet nozzle extending from the liquid outlet;
a foaming media; and
one or more air inlet apertures located downstream of the liquid outlet and upstream of the foaming media.

8. The refill unit of claim 7 wherein fluid flowing through the arcuate shaped pump chamber flows in a plane that is substantially perpendicular to a direction of fluid flow in the outlet nozzle.

9. The refill unit of claim 7 wherein the arcuate shaped pump chamber is along a substantially horizontal axis and the outlet nozzle extends along a substantially vertical axis.

10. A foam dispenser comprising:
a housing;
an air pump secured to the housing;
an actuating mechanism secured to the housing;
the actuating mechanism comprising:
a motor;
a swipe gear secured thereto;
a refill unit installed in the dispenser;
the refill unit comprising a container and a liquid pump secured to the container;
the liquid pump having a flexible membrane and a back plate that form an arcuate pump chamber and an outlet nozzle;
wherein rigid plate lies in a first plane;
wherein an arc of the arcuate pump chamber lies along a second plane substantially parallel to the first plane;
wherein rotation of the swipe gear progressively compresses the arcuate pump chamber from the inlet of the arcuate pump chamber to the outlet of the arcuate pump chamber during actuation of the pump; and
wherein the motor drives both the liquid pump and the air pump.

11. The foam dispenser of claim 10, wherein a liquid pump drive reduces a speed of the motor to drive the liquid pump.

12. The foam dispenser of claim 11, wherein an air pump is driven at a greater speed than the liquid pump.

13. The foam dispenser of claim 10, wherein the swipe gear has less than three projections.

14. The foam dispenser of claim 13, wherein at least one of the projections is a roller.

15. The foam dispenser of claim 10 further comprising a liquid inlet valve upstream of the arcuate pump chamber and a liquid outlet valve downstream of the arcuate pump chamber.

16. The foam dispenser of claim 10 wherein the outlet nozzle includes an aperture for receiving air to mix with a liquid to form a foam.

17. The foam dispenser of claim 10 wherein the arcuate pump chamber is along a substantially horizontal plane.

18. The foam dispenser of claim 10 wherein the arcuate pump chamber is along a substantially vertical plane.

19. The foam dispenser of claim 10 wherein the arcuate pump chamber is along a bottom surface of the refill unit.

20. The foam dispenser of claim 10 wherein the refill unit further includes a vent valve to vent the container.

* * * * *